US011051661B2

(12) United States Patent
Forutanpour

(10) Patent No.: US 11,051,661 B2
(45) Date of Patent: Jul. 6, 2021

(54) APPARATUS AND METHOD FOR A CONVENIENCE TOWEL

(71) Applicant: Babak Forutanpour, Carlsbad, CA (US)

(72) Inventor: Babak Forutanpour, Carlsbad, CA (US)

( * ) Notice: Subject to any disclaimer, the term of this patent is extended or adjusted under 35 U.S.C. 154(b) by 87 days.

(21) Appl. No.: 16/435,513

(22) Filed: Jun. 9, 2019

(65) Prior Publication Data

US 2020/0383529 A1 Dec. 10, 2020

(51) Int. Cl.
*F26B 13/26* (2006.01)
*A47K 10/02* (2006.01)
*A47K 10/24* (2006.01)

(52) U.S. Cl.
CPC ..... *A47K 10/02* (2013.01); *A47K 10/24* (2013.01)

(58) Field of Classification Search
CPC ..... A47K 10/02; A47K 10/24
USPC ..... 34/95, 397
See application file for complete search history.

(56) References Cited

U.S. PATENT DOCUMENTS

| | | | | |
|---|---|---|---|---|
| 4,516,616 | A * | 5/1985 | Fesler | A63B 57/00 150/154 |
| 2013/0323457 | A1* | 12/2013 | Barringer | A47K 10/02 428/99 |
| 2014/0186571 | A1* | 7/2014 | Wilkinson | A47G 11/001 428/64.1 |
| 2017/0086605 | A1* | 3/2017 | Wolfe | A47G 9/062 |
| 2020/0279448 | A1* | 9/2020 | Plamondon | A47K 10/04 |

* cited by examiner

*Primary Examiner* — John P McCormack

(57) ABSTRACT

An apparatus and method are described for a convenience towel. The disclosed embodiments describe, amongst other things, for example, a towel that may be draped over a "water" bottle. The towel may comprise a variety of shapes and may have one or more layers. The towel may have an opening that may allow a bottle spout to protrude making it available to consumers. In addition, the towel may have a handle or loop for gripping.

17 Claims, 5 Drawing Sheets

APPARATUS AND METHOD FOR A CONVENIENCE TOWEL

BACKGROUND

I. Field

The disclosed embodiments relate to an apparatus and methods for a convenience towel.

II. Background

During exercise, at home or at the gym, or while playing sports such as tennis, golf, basketball, or other games, it is common for people to carry a towel to wipe off perspiration, especially from their face. The issue arises when one looks for a clean location to place their towel when it is not in use. While some may leave their towel on a nearby bench, on top of the equipment they are currently using at the gym, or even on the ground, it would be advantageous to have a location where one could place their towel to help protect everyone from germs. For some, it may be desirable to place their towel over their own water bottle which they often have with them at these events for hydration. Moreover, a caregiver may desire to place a towel (wipe cloth) onto a baby's bottle. Therefore, there is a need in the art for a convenience towel.

SUMMARY

Apparatuses and methods for a convenience towel are described. In an embodiment, a convenience towel is described, comprising: at least one towel layer; an opening in the towel; and a handle attached to the towel.

In another embodiment, a disposable convenience towel pack is described, comprising: a plurality of disposable convenience towels, the plurality of disposable convenience towels stacked one on top of another to form a stack of disposable convenience towels; the plurality of disposable convenience towels having openings towards the center of the towels; and the plurality of disposable convenience towels having a handle.

In yet another embodiment, a method for using a convenience towel, is described comprising: draping a convenience towel over a bottle; removing the convenience towel from the bottle; wiping a surface area with the convenience towel; and replacing the convenience towel back over the bottle;

BRIEF DESCRIPTION OF THE DRAWING

The following embodiments may be better understood by referring to the following figures. The figures are presented for illustration purposes only, and may not be drawn to scale or show every feature, orientation, or detail of the embodiments. They are simplified to help one of skill in the art understand the embodiments readily, and should not be considered limiting.

DETAILED DESCRIPTION

Each of the additional features and teachings disclosed below can be utilized separately or in conjunction with other features and teachings to provide a method and apparatus for a convenience towel designed to be stored on top of a "bottle." Applications for the disclosed embodiments are not meant to be limited to just "sport" type applications, but rather, broadly apply to other uses as is readily apparent to a POSA. Representative examples of the following embodiments, will now be described in further detail with reference to the attached drawings. This detailed description is merely intended to teach a person of skill in the art details for practicing the preferred aspects of the teachings and is not intended to limit the scope of the embodiments.

The disclosed embodiments describe a convenience towel, a method of using and making a convenience towel. Towel, herein, broadly includes any cloth used to wipe down or clean a surface. For example, in an embodiment, towel may include a gym towel, a face towel, any sized towel, wipe cloth, paper, or a rag. It may be made of cotton, fabric, cloth, terrycloth, lycra, nylon, polyester, micro-fiber, linen, bamboo fiber, or any combinations thereof. Moreover, the towel/s may be disposable or washable. Furthermore, the term bottle is used, herein, to broadly mean any container that holds liquid, such as water bottle, canteen, thermos, half-gallon jug, can, jar, jug, cup, made of a variety and combination of materials such as glass, wood, metal, plastic, paper, or any combinations thereof.

Figure 1A:
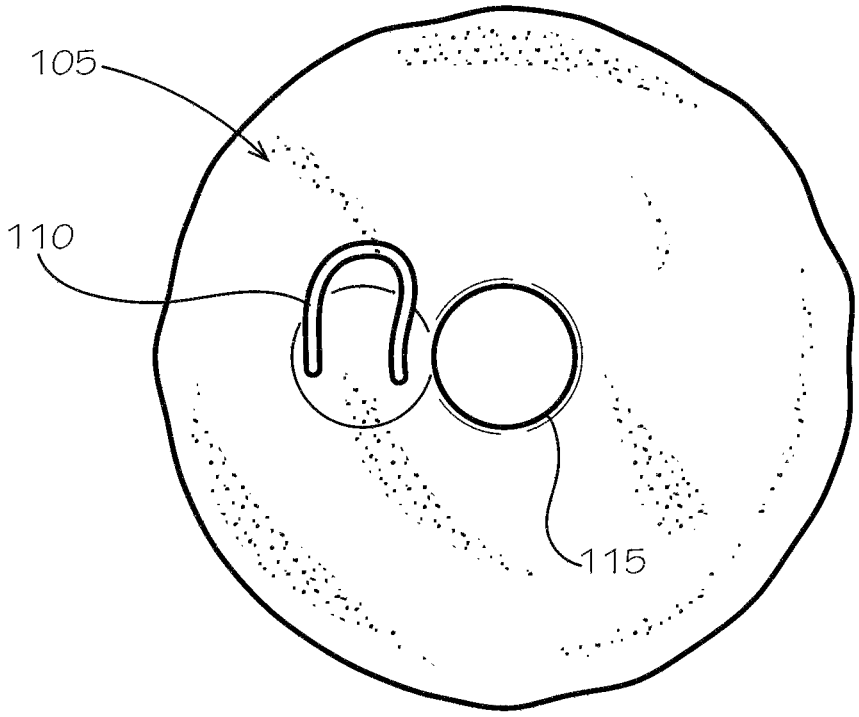
FIG. 1A illustrates a circular convenience towel in an embodiment.

FIG. 1A illustrates a circular convenience towel 105 in an embodiment. In an embodiment, half the diameter of the towel 105 is less than the height of a conventional "water" bottle. For example, if a water bottle's height is between 4 and 8 inches high, the towel's total diameter may be between 6 to 14 inches wide, such that when the towel is draped on the bottle, no part of it may come into contact with the surface the bottle is resting on (e.g. a floor, equipment, desk, etc.). In an embodiment, the towel's diameter may be between 4 and 24 inches. In an embodiment, the circular towel 105 may have one or more openings 115 such that a spout or top of a bottle may still be accessible when the towel is placed over it. In an embodiment, the diameter of the at least one opening/s 115 may be between 1 inch and 3 inches. The opening 115 may be any shape and is shown here as a circular shape. In another embodiment, the towel 105 may have one or more loops (or handle) 110 used as a grip. In an embodiment, the loop may have a diameter bigger than an average finger, for example between 0.5 inch and 2 inches, and may be located either immediately next to, adjacent to, on the side of the towel, or over the opening(s) 115, such that a user may easily grasp and remove or place over a bottle. In another embodiment, the loop 110 may be located elsewhere on the towel 105. The loop(s) 110 may be comprised of fabric, silicon, string, ribbon, cord, rubber, paper, cardboard, plastic, or any material that is suitable for a disposable or washable towel application. The loop(s) 110 may also be permanently secured to the towel 105, or removably secured to the towel 105. In an embodiment, the loop(s) 110 may be removably secured via hook-loop (Velcro) connection, snaps, buttons, ties, or any suitable removably secured connectors. In an embodiment, loop(s) 110 may be removably secured such that a user may position them on the towel 105 were they desire.

The towel 105 may comprise materials that allow printing. For example, a gym may wish to sell the towels 105 with their logo printed on it. In other embodiments, the shape of the towel 105 may be elliptical, oval, triangular, square, caricature, or rectangular. Many various shapes may be used and are too numerous to list or illustrate in the attached drawings. For example, a cute animal shape may be used for a baby's bottle application. The embodiment of a circular towel 105 is used primarily throughout for simplicity of the drawings, but isn't considered the only embodiment, nor is the intent of the inventor to have it as the only shape. Other shapes obviously provide advantages over others for some applications.

Figure 1B:
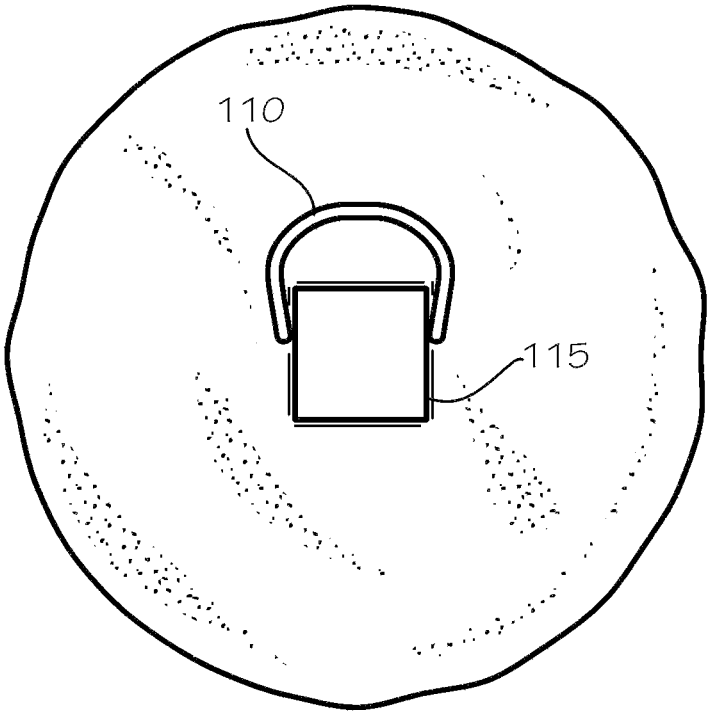
FIG. 1B illustrates another circular convenience towel in an embodiment.

FIG. 1B illustrates another circular convenience towel 105 in an embodiment. As shown in FIG. 1B, the handle 110 is located over the opening 115, but in this embodiment, the handle 110 is located towards one side of the opening. Also, in an embodiment, as shown in FIG. 1B, the opening is shown as a square opening.

Figure 2A:
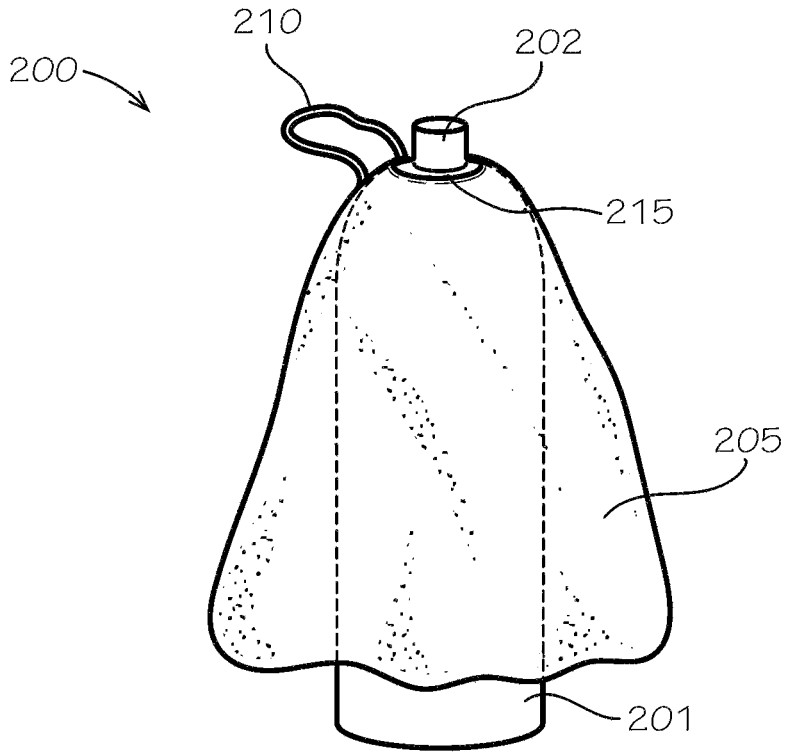
FIG. 2A illustrates a convenience towel draped on top of a bottle in an embodiment.

FIG. 2A illustrates a convenience towel draped on top of a bottle 200 in an embodiment. Towel 205 may have an opening 215 and a handle 210 draped over a generic "water" bottle 201. In an embodiment, the spout 202 of the water bottle 201 is accessible through opening 215. A user may desire to simply lift the bottle 201 with the towel 205 on it to drink. When the user wishes to wipe their face or other body part, they may place a finger through the handle 210, and lift the towel 205 off the bottle 201. A user if they so desire, may roll their wrist such that the underside of the towel (if the user so desires a "clean" side) may then face upwards, allowing the user to wipe their face easily. After wiping their face, the user may lower the towel back over the bottle with the spout of the water bottle 202 coming through opening 215.

In an embodiment, the handle 210 may be to the side of the opening 215, such that a user's nose may not touch the loop when the towel and bottle are lifted together in order to drink. In another embodiment, the opening 215 may not be in the center of the towel, but rather off center in order to accommodate the various different bottle spouts and openings on the market.

Figure 2B:
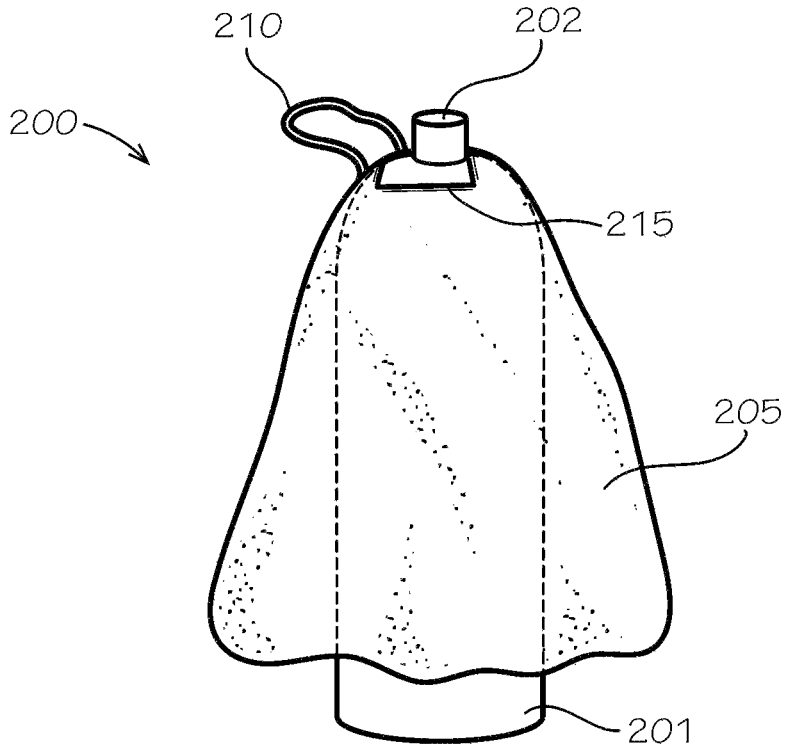
FIG. 2B illustrates a convenience towel draped on top of a bottle in another embodiment.

FIG. 2B illustrates a convenience towel 200 draped on top of a bottle in another embodiment. As shown in FIG. 2B, the opening 215 may be located off center on the towel 205. The opening 215 may be a rectangular shaped opening. The towel 205 may be a rectangular or square shaped towel.

Figure 3:
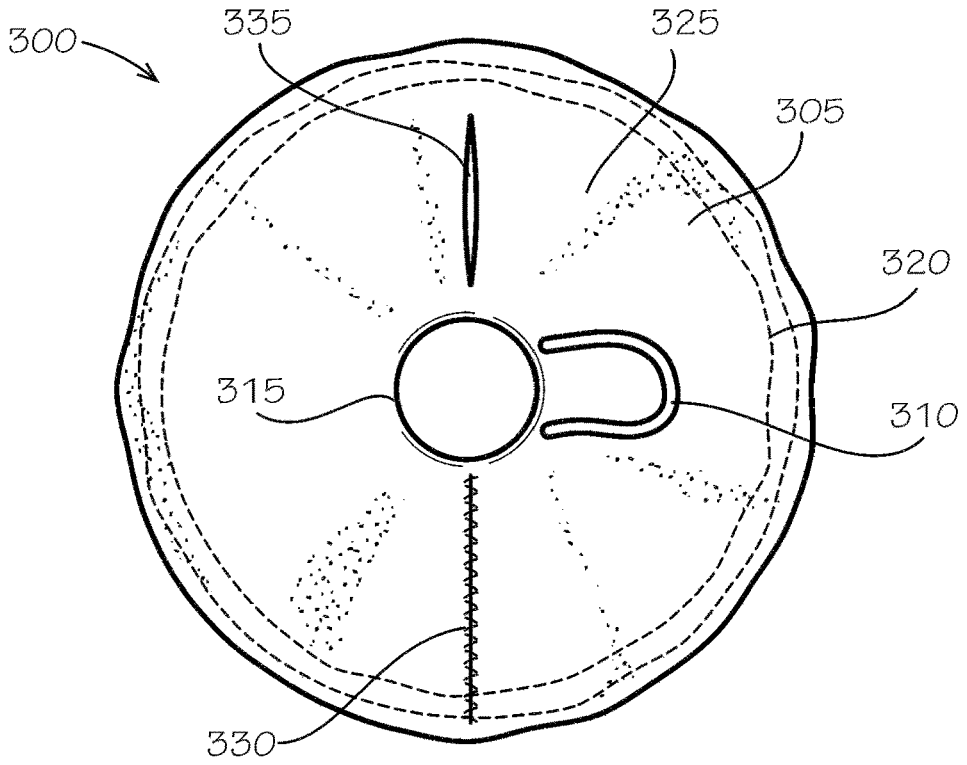
FIG. 3 illustrates a convenience towel with more than one layer in an embodiment.

FIG. 3 illustrates a convenience towel with more than one layer 300 in an embodiment. In an embodiment, the towel 300 may comprise one or more layers, where one layer 325 may be used to wipe down equipment, while another layer 305 may be used for wiping one's face (just provided as an example). Thus, convenience towel 300 may have a top (outer layer) 325 and a bottom (inner layer) layer 305 comprising the same or different materials for different applications of use. The layers may be joined together at the opening 315, or may be joined by one or more "tacking" seams 330 on the towel body. In an embodiment, there may be a third layer 320 between outer and inner layers 305 and 325. In an embodiment, inner layer 320 may comprise a water resistant material such as thermoplastic polyurethane, such that moisture and germs from 325 do not reach 305. In an embodiment, each layer would have its own opening and drape over the bottle. In an embodiment, each layer's opening may be attached together at the opening 315 edge. In another embodiment, only the top layer, 325, may have a handle 310. The different layers of the towel may be sewn, glued, buttoned, hook & loop connected, stapled, removably connected or permanently connected in a variety of methods.

In an embodiment, towel 300 may be scored or have cutouts 335 in certain areas to help the fabric fold in those areas more easily (only one is shown in FIG. 3, but more than one may be present), helping the towel 300 drape over the bottle more elegantly. In an embodiment, the cutout(s) 335 may also function as a handle 310 and/or a tacking of the layers at the cutout(s) edge(s). In another embodiment, the layers may be reversible and there may be a handle 310 located on each layer. In an embodiment, the outer layer 325 may be longer (or larger in radius) than the inner 305 or middle layer 320. The inner layer may be shorter (or smaller radius) than the outer 325 or middle layer 320. In an embodiment, the outer layer 325 is larger than the middle layer 320 and the middle layer 320 is larger than the inner layer 305.

Figure 4:
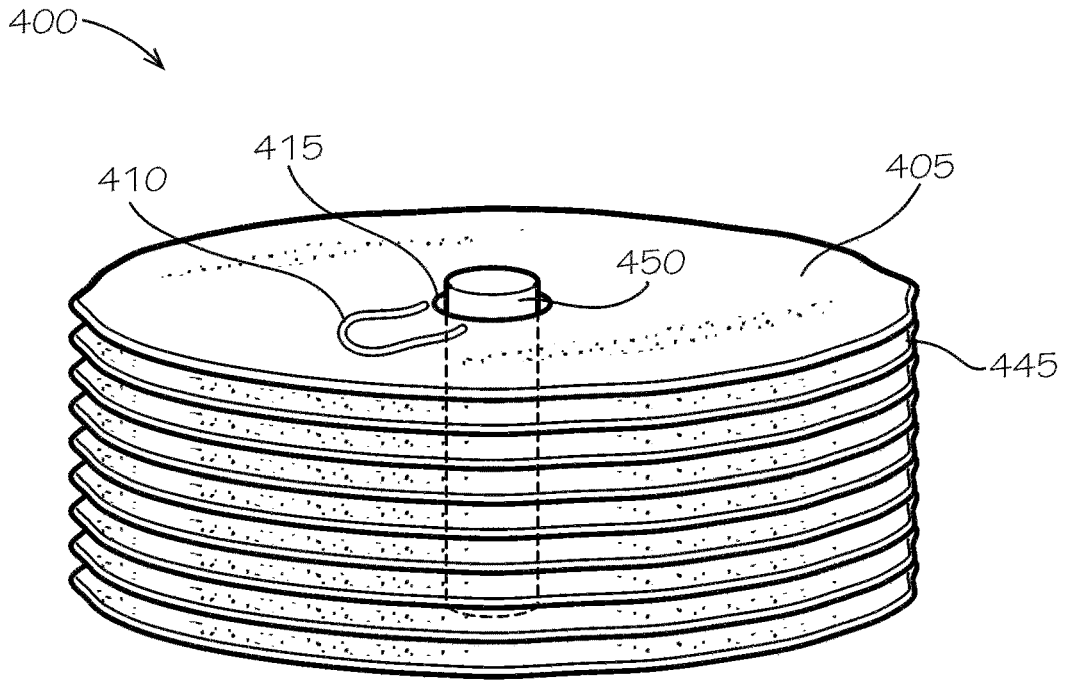
FIG. 4 illustrates a disposable convenience towel commercial embodiment.

FIG. 4 illustrates a disposable convenience towel commercial embodiment 400. In an embodiment, the towels 405 are made of a disposable material. For example, they could be made out of a paper product like a paper towel, or cheap thin terrycloth. The towels 405 may in an embodiment, come as a stack of towels 445. The handle (tab) 410 may be made of thick paper like cardboard or plastic, or a suitable material for firmness of use but disposability of material. The handle 410 may lay flat until a user engages it by lifting it. In an embodiment, towels 405 may come on a roll 450 that helps hold them in place: the towel opening(s) 415 may be fed onto a roll 450. In another embodiment, the stack of towels 445 may be a stack that isn't supplied on a roll 450.

Figure 5:
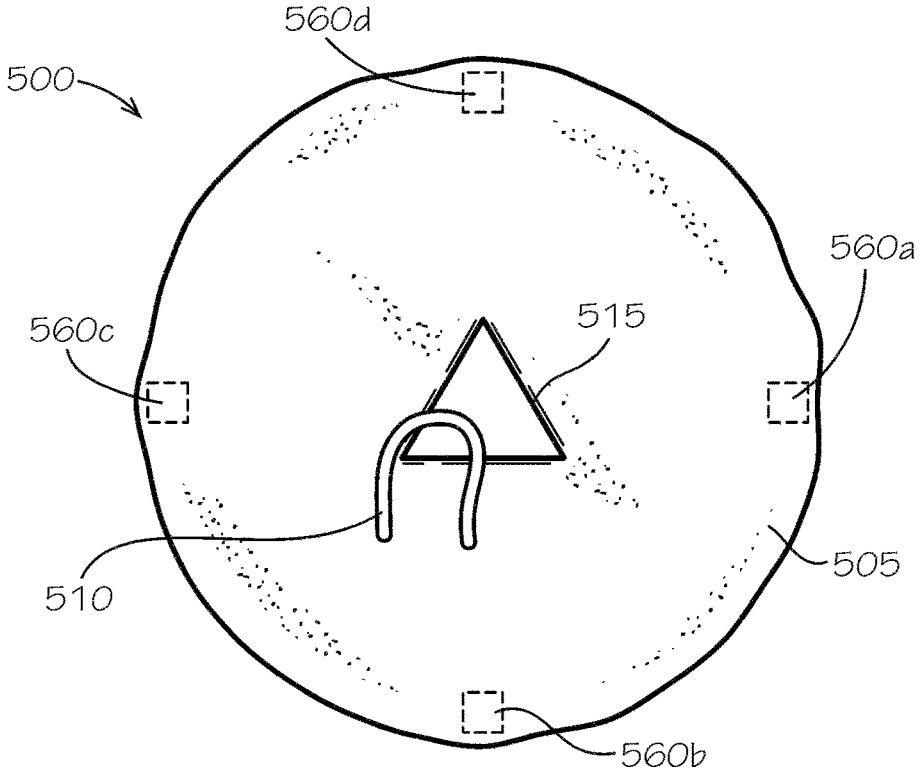
FIG. 5 illustrates a weighted convenience towel in an embodiment.

FIG. 5 illustrates a weighted convenience towel 500 in an embodiment. In an embodiment, the towel 505 may have one or more small weights 560(*a-d*) around the perimeter. In an embodiment, there may be between two to four weights 560(*a-d*). The presence of weights may serve multiple purposes. First, they may help the towel drape over the water bottle more elegantly, helping the towel hug the sides of the water bottle, and may help it have a more pleasing aesthetic. Second, they may help the user access the clean underside of the towel more easily. For example, a user may give a quick lift of the towel off the bottle and flick of the wrist. The weights may provide momentum for the towel edges "to fly apart," more readily. In an embodiment, the weights 560 may be sewn (or permanently attached) into the towel.

Figure 6:
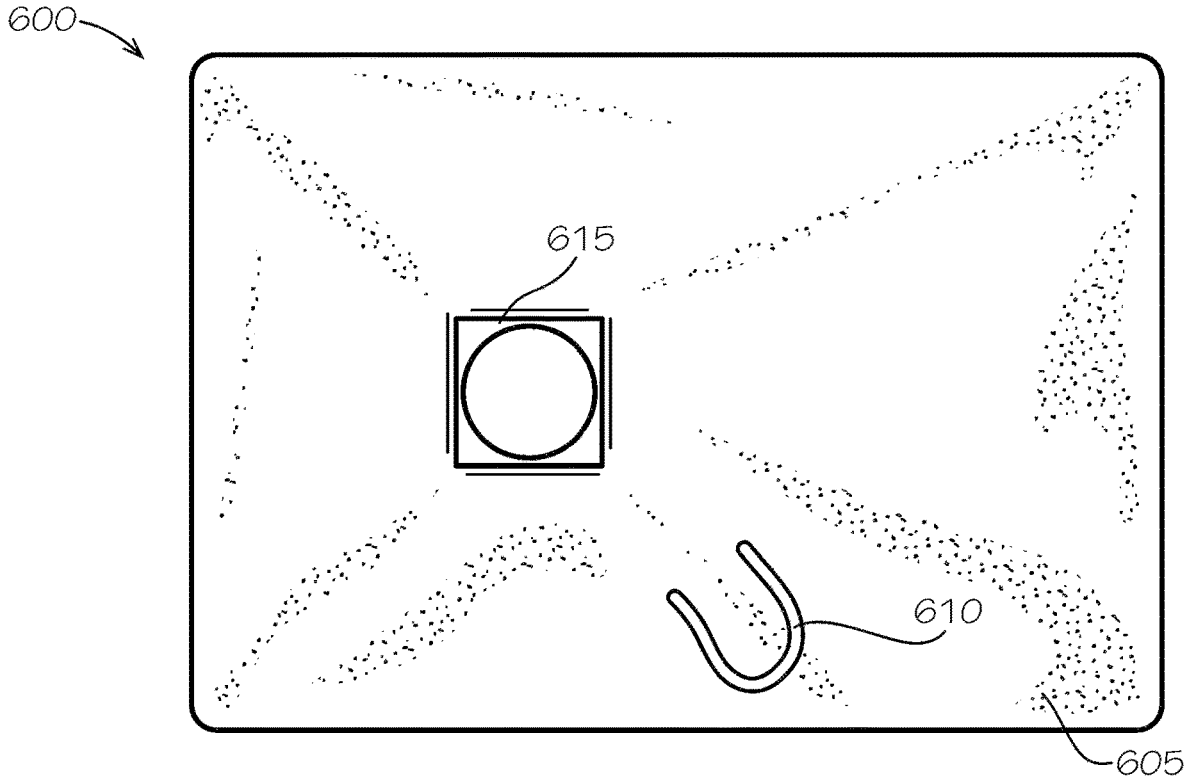
FIG. 6 illustrates a rectangular shaped convenience towel in an embodiment.

FIG. 6 illustrates a rectangular shaped convenience towel 600 in an embodiment. In an embodiment, towel 600 may have an opening off center 615, and a loop 610 located in a quadrant of the towel 600.

Figure 7:
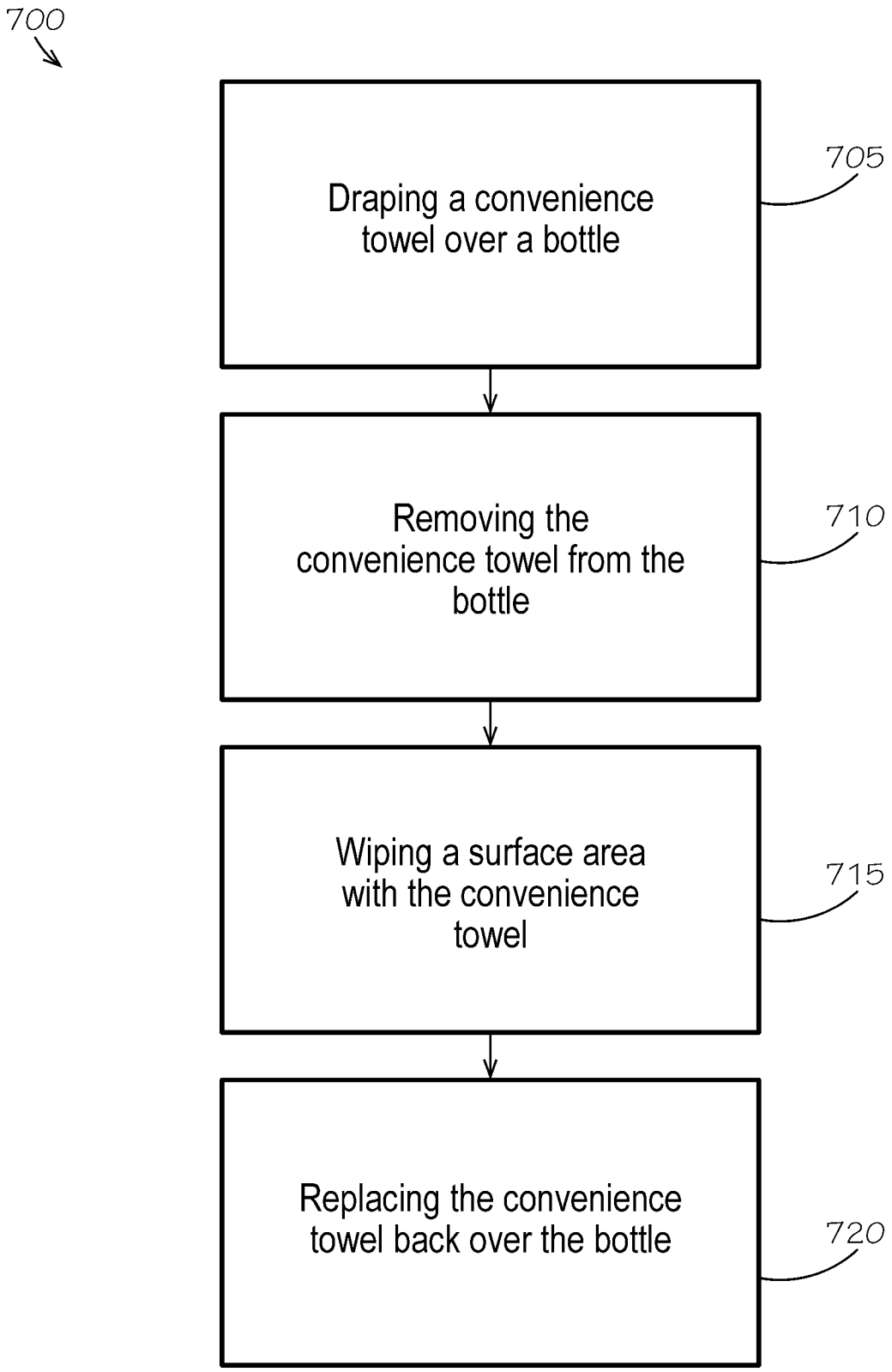
FIG. 7 illustrates a method of using a convenience towel in an embodiment.

FIG. 7 illustrates a method 700 of using a convenience towel in an embodiment. The method 700 may improve a users experience while working out or playing sports etc. A user may not need to look for a clean location to place their towel, may be able to readily identify which towel is theirs, and may be protected from germs. Method 700 begins at step 705, with draping a convenience towel over a bottle. At step 710, removing the convenience towel from the bottle. Then at step 715, wiping a surface area with the convenience towel. And finally, at step 720, replacing the convenience towel back over the bottle. The convenience towel used in method 700 may be any of the above disclosed embodiments.

The foregoing description of the preferred embodiments has been presented for purposes of illustration and description. It is not intended to be exhaustive or to limit the embodiments to the precise form or to exemplary embodiments disclosed. Obviously, many modifications and variations will be apparent to practitioners skilled in this art. Similarly, any process steps described might be interchangeable with other steps in order to achieve the same result. The embodiments were chosen and described in order to best explain the principles of the embodiments and its best mode practical application, thereby to enable others skilled in the art to understand the various embodiments and with various modifications as are suited to the particular use or implementation contemplated. It is intended that the scope of the embodiments be defined by the claims appended hereto and their equivalents. Reference to an element in the singular is not intended to mean "one and only one" unless explicitly so stated, but rather means "one or more." Moreover, no element, component, nor method step in the described disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . ."

In addition, the conjunction "and" when used in the claims is meant to be interpreted as follows: "X, Y and Z" means it can be either X, Y or Z individually, or it can be both X and Y together, both X and Z together, both Y and Z together, or all of X, Y, and Z together.

It should be understood that the figures illustrated in the attachments, which highlight the functionality and advantages of the described embodiments, are presented for example purposes only. The architecture of the described embodiments are sufficiently flexible and configurable, such that it may be utilized (and navigated) in ways other than that shown in the accompanying figures.

Furthermore, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the described embodiments in any way. It is also to be understood that the steps and processes recited in the claims need not be performed in the order presented.

Also, it is noted that the embodiments may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function. A process or method may be implemented with a processor, or similar device, or any combination of hardware and software.

The various features of the embodiments described herein can be implemented in different systems without departing from the embodiments. It should be noted that the foregoing embodiments are merely examples and are not to be construed as limiting the embodiments. The description of the embodiments is intended to be illustrative, and not to limit the scope of the claims. As such, the described teachings can be readily applied to other types of apparatuses and many alternatives, modifications, and variations will be apparent to those skilled in the art.

What is claimed is:

1. A convenience towel, comprising:
at least one towel layer;
an opening in the towel;
a handle attached to one side of the towel;
the handle is proximate to the opening; and
the handle is offset from the opening, in a radial direction.

2. The convenience towel of claim 1, wherein the towel is a circular, oval, rectangular, square, square, triangular, and caricatured shaped.

3. The convenience towel of claim 1, further comprising:
the at least one towel layer comprises a first outer layer; and
a second inner layer.

4. The convenience towel of claim 3, further comprising:
a third middle layer.

5. The convenience towel of claim 4, wherein the middle third layer comprises a water resistant material.

6. The convenience towel of claim 5, wherein the first outer layer has a larger diameter than the third middle layer, and the third middle layer has a larger diameter than the second inner layer.

7. The convenience towel of claim 1, wherein the at least one towel layer comprises materials of cotton, cloth, fabric, terrycloth, lycra, nylon, polyester, micro-fiber, linen, bamboo fiber, or any combinations thereof.

8. The convenience towel of claim 1, further comprising:
at least one weight attached to the at least one towel layer.

9. The convenience towel of claim 1, further comprising:
at least one cutout in the at least one towel layer.

10. The convenience towel of claim 1, wherein the opening may be a circular, oval, square, rectangle, and triangular shape.

11. The convenience towel of claim 1, wherein the opening may be between 0.5 and 3 inches in diameter.

12. The convenience towel of claim 1, wherein the opening may be located off-center or centered on the towel.

13. The convenience towel of claim 1, wherein the handle may be a circular, oval, square, rectangle, and triangular shape.

14. The convenience towel of claim 3, wherein the first outer layer and the second inner layer are removably connected together or permanently joined together.

15. The convenience towel of claim 1, wherein the at least one towel layer has a diameter between 4 and 24 inches.

16. A disposable convenience towel pack, comprising:
a plurality of disposable convenience towels, the plurality of disposable convenience towels stacked one on top of another to form a stack of disposable convenience towels;
the plurality of disposable convenience towels having openings towards their center; and
the plurality of disposable convenience towels each having a handle.

17. The disposable convenience towel pack of claim 16, wherein the plurality of disposable convenience towels are a circular, oval, rectangular, square, and triangular shaped.

* * * * *